US005769755A

United States Patent [19]

Henry et al.

[11] Patent Number: 5,769,755

[45] Date of Patent: Jun. 23, 1998

[54] WORKOUT LEVEL INDICATOR

[75] Inventors: George F. Henry, Woodinville; James S. Birrell, Seattle, both of Wash.

[73] Assignee: Precor Incorporated, Bothell, Wash.

[21] Appl. No.: 881,871

[22] Filed: Jun. 24, 1997

Related U.S. Application Data

[63] Continuation of Ser. No. 494,107, Jun. 23, 1995, abandoned.

[51] Int. Cl.[6] ..... A61B 5/00

[52] U.S. Cl. ..... 482/8; 482/3; 482/9; 482/901; 116/212

[58] Field of Search ..... 482/1–9, 900–902; 73/379.01; 116/212

[56] References Cited

U.S. PATENT DOCUMENTS 3,767,195 10/1973 Dimick .
4,170,225 10/1979 Criglar et al. ..... 482/900
4,566,461 1/1986 Lubell et al. .
4,790,528 12/1988 Nakao et al. .
4,911,427 3/1990 Matsumoto et al. .
4,934,692 6/1990 Owens .
4,976,424 12/1990 Sargeant et al. .
5,149,084 9/1992 Dalebout et al. .
5,230,672 7/1993 Brown et al. .
5,318,487 6/1994 Golen et al. .

*Primary Examiner*—Richard J. Apley
*Assistant Examiner*—Glenn E. Richman
*Attorney, Agent, or Firm*—Christensen, O'Connor, Johnson and Kindness

[57] ABSTRACT

An exercise display system for aiding a user in maintaining a desired exercise intensity level includes input means for inputting relevant physiological information about the user, calculation means for calculating a spectrum of exercise intensity levels, sensor for detecting the physiological condition of the user during exercise, and display means (32) for displaying the user's exercise intensity within a first scale (20) of at least two levels (22) of possible exercise intensities. The scale (20) includes a Below Training Zone (23), a Weight Loss Training Zone (24), a Cardiovascular Training Zone (25), and an Above Training Zone (26). The display means (32) also includes a second scale (28) of subdivisions (30) of intensity levels, e.g., maximum heart rate percentages or range of heart beat rates. The subdivisions (30) may preferably flash or may be caused to turn a specific color when the exerciser's physiological condition is represented by that subdivision. The display system (32) indicates the intensity of the user's exercise within the subdivisions during the user's exercise workout, as received by the sensor.

45 Claims, 6 Drawing Sheets

WORKOUT LEVEL INDICATOR

This application is a continuation application of application Ser. No. 08/494,107, filed on Jun. 23, 1995, now abandoned.

FIELD OF THE INVENTION

The present invention relates to exercise equipment, and more particularly to exercise display systems for indicating the intensity of a user's workout.

BACKGROUND OF THE INVENTION

Exercise is a valuable part of the lives of many people and is used in a variety of situations to obtain different physiological results. For example, one person may use exercise to lose weight. Another to train for the Olympics. Another for rehabilitation of an injury. And yet another to improve respiratory and circulatory systems. The benefits of exercise are closely tied with the intensity and duration of the exercise performed. Intensity, which may be thought of as the effort expended by an individual, is reflected in the individual's physiological condition, e.g., heart rate, breathing rate, and metabolism. Depending on the exercise goal, a particular workout may be created by simply adjusting the intensity and duration of the exercise performed.

A generally accepted principal of exercise (and in particular, aerobic exercise), is that the heart rate should be maintained within a range of about 60% to 85% of the subject's maximum heart rate in order to obtain a benefit from a workout. This range is referred to as the fitness training range. If the exerciser is performing at an intensity level below the fitness training range, then very little aerobic benefit is received. If an exerciser is performing at an intensity level between roughly 60% to 70% heart rate level, then he or she will receive mostly a caloric benefit. Therefore, many exercisers may wish to maintain this level of exercise intensity in order to lose weight. As the exerciser's heart rate increases within the fitness training range, the cardiovascular benefits increase. Between 70% and 85% heart rate levels, most individuals will be burning calories as well as getting a good cardiovascular workout. If the exerciser is performing at a level above the fitness training range, then the workout may become anaerobic (or oxygen-depleting). Exercise at such an excessive level generally does not yield additional improvements in the body's fitness. Thus, it is important to monitor levels of intensity to ensure that exercise intensity falls within the fitness training range, and depending on the intent of the exerciser, to ensure that the exercise is conducted at the intensity level desired. For example, a person wanting to strengthen a particular muscle group after an injury, may wish to exercise according to a regime advised by a physical therapist, such as high-intensity, low-duration sets. A person wanting to train for a marathon may wish to perform a low-intensity, high-duration workout.

The above heart rates, used to describe the fitness training range, provide a good general guide in gauging workout intensity. Each individual's particular fitness training range, however, will vary according to a number of factors, such as age, sex, weight, resting heart rate, etc. A fragile 80-year-old female will have a fitness training range that requires much less exertion than a 20-year-old male athlete. For her, an appropriate fitness training range for her age should reflect her naturally lower maximum heart rate. In addition, her fragile physical state may alter the fitness training range to 55% to 80%. Therefore, it is important for an individual to be able to monitor their exercise intensity level within a fitness training range tailored according to their individual circumstances.

Various exercise equipment and display systems are currently available for aiding an exerciser during their workout. However, none are particularly useful in helping the exerciser easily understand where he or she is in terms of their own fitness training range during a workout. For example, some heart rate monitors or fitness monitors (e.g., U.S. Pat. No. 4,566,461) alert the exerciser when their heart rate goes above the 85% level or below the 60% level. This only helps the person to keep his or her exercise intensity level from going above or below the fitness training range. A number of devices (e.g., as in U.S. Pat. No. 5,318,487 or U.S. Pat. No. 4,976,424) display current heart rate and some devices (e.g., as in U.S. Pat. No. 4,911,427) also suggest a target heart rate. Each of these devices have the disadvantage of not providing an overall indication of the person's fitness training range or where the user's exercise intensity falls within their fitness training range during their workout.

It can be seen that what is required is a display system that allows a user to see a spectrum of exercise intensity levels that have been created specifically for that individual. The ideal display system should also alert the exerciser as to the level of exercise intensity at which he/she is performing within the spectrum. In this way, the exerciser can understand where he/she is relative in his/her workout intensity according to a range of intensity levels that have been tailored for that person, and adjust his/her exertion level accordingly.

SUMMARY OF THE INVENTION

In accordance with the present invention, an exercise display system for aiding a user in maintaining a desired exercise intensity level is provided. The display system includes input means for inputting relevant physiological information about the user, calculation means for calculating a spectrum of exercise intensity levels for a particular user, sensor for detecting the physiological condition of the user, and display means for displaying the user's current exercise intensity based on the detected physiological condition during exercising. The display means includes a first scale of at least two levels of possible exercise intensities.

In accordance with still further aspects of the present invention, an exercise display system is provided that eliminates the need for the exerciser to perform mathematical calculations in order to verify their level of exercise intensity at any given time.

In accordance with further aspects of the present invention, the preferred levels of possible exercise intensity include a below training zone, a weight loss training zone, a cardiovascular training zone, and an above training zone. The display means includes indicia that represents each of these levels, the indicia preferably representing each level by a different colored light.

In accordance with other aspects of the present invention, the display means includes a second scale of subdivisions of exercise intensity. In a first preferred embodiment, the second scale includes a number of small lights that represent a range of heart rate subdivisions. The calculation means calculates which subdivisions correspond to which of the intensity level, based in part on information received from the input means. In a second preferred embodiment, the subdivision are a plurality of spaced apart lights, a fixed number of which always correspond to a particular intensity level. The calculation means calculates the values of each of the subdivisions corresponding to each intensity level, again based in part on information received from the input means.

In accordance with still other aspects of the present invention, the subdivisions of the display means may include lighted or high contrast indicia that flash when the intensity of the user's exercise is represented in that subdivision. In an alternative preferred embodiment, the subdivisions of the display means are a particular color when the intensity of the user's exercise is represented in that subdivision.

BRIEF DESCRIPTION OF THE DRAWINGS

The foregoing aspects and many of the attendant advantages of this invention will become more readily appreciated as the same becomes better understood by reference to the following detailed description, when taken in conjunction with the accompanying drawings, wherein.

DETAILED DESCRIPTION OF THE PREFERRED EMBODIMENT

Figure 6:
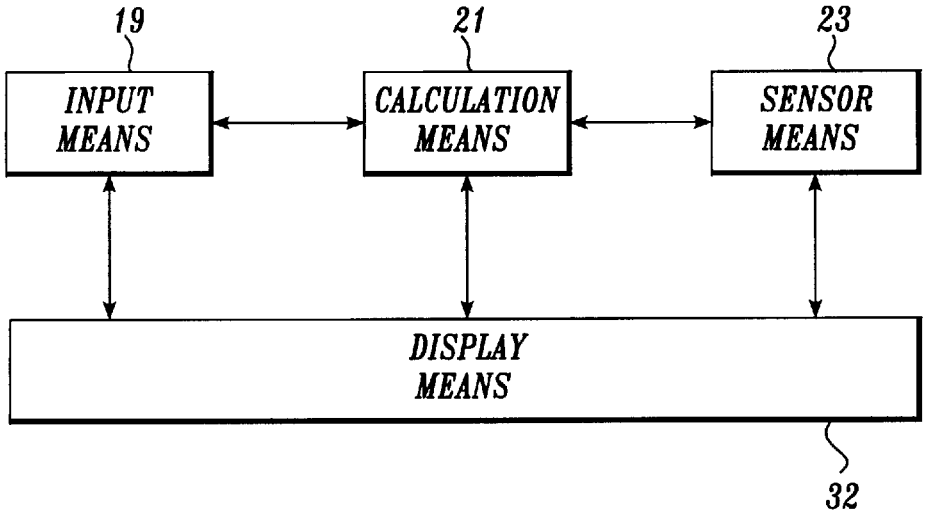
FIG. 6 is a schematic view of a display system constructed in accordance with the present invention.

In general, a display system constructed in accordance with the present invention comprises a flat rectangular display 18 capable of attachment to a piece of exercise equipment or to the user, himself or herself. Referring to FIG. 6, the display system generally includes input means 19, calculation means 21, sensor 23, and display means 32. Various indicia are used to display a spectrum of exercise intensities based on the exerciser's individual characteristics and an indication of the exerciser's current exercise intensity within that spectrum. The display system may be powered using one of a variety of energy sources, including solar, battery, or power outlet.

More specifically, the input means 19 allow the exerciser to input physiological information about himself or herself. Typical pieces of information include weight, age, sex, build, resting heart rate, etc. Additional input data may include the exerciser's perceived or actual fitness capacity, e.g., the exerciser may be able to input that he or she is a frequent exerciser, already in good shape; an occasional exerciser in fair condition; a non-exerciser in average health; a convalescent; etc. The method used for inputting the physiological information may be one of a multitude of available input methods, e.g., a keypad, a menu selection system, a voice input means, a metabolic sensor, etc.

The physiological information is passed to the calculation means 21 which estimates a spectrum of exercise intensity levels, including a first scale of exercise intensity levels and a second scale of subdivisions of intensity. The spectrum is based on the physiological information entered by the exerciser through the input means, as well as known physiological relationships related to exercise. In addition, if the calculation means is a computer having a memory unit, the input means may include a user identification system to enable the calculation means to retrieve history information about the particular user for use by the calculation means. The first scale of intensity levels are basically zones within which a particular exercise benefit may be obtained if the exerciser performs within that zone. The scale of intensity subdivisions are subparts of each of these zones. The intensity levels and subdivisions are preferably calculated in terms of heart rate, but may be defined in terms of other factor(s) relevant to workout intensity. The calculation means thus creates a spectrum of exercise intensity levels unique to the exerciser. The calculation means may be one of various types known to those skilled in the art of calculation mechanisms, e.g., a computer.

Sensor means 23 are connected to the exerciser for detecting the physiological condition of the user during a workout. The preferred sensor detects heart rate, either continuously or at frequent intervals; although, other physiological conditions (e.g., oxygen intake) may be used to determine the condition of the user during the workout. Whatever physiological condition, or conditions, are selected, they should bear a relationship to the spectrum of exercise intensity levels determined by the calculation means.

In general, the display means 32 includes two parts: a display of the first scale 20 of exercise intensity levels 22 and a display of the second scale 28 of intensity level subdivisions 30. The display of the first scale shows a fixed number of levels 22 that are usually labeled to indicate the benefit of exercising at that intensity level. The scale has at least two intensity levels 22, and preferably four. The preferred intensity levels 22 are: a Below Training Zone 23, a Weight Loss Training Zone 24, a Cardiovascular Training Zone 25, and an Above Training Zone 26.

The display of the second scale 28 shows a fixed number of subdivisions 30 that may be labeled in various ways, as discussed below. The display means 32 receive information from the calculation means indicating in what manner the subdivisions are to be divided amongst the intensity levels 22. During an exerciser's workout, the display means 32 receives physiological information from the sensor that enables the display means 32 to indicate to the user their current level of exercise intensity. These aspects are discussed further below in the discussion of two preferred embodiments of a display system constructed in accordance with the present invention. In more complicated embodiments, the calculation means may receive information from the sensor and may use such information to calculate the level of intensity at which the exerciser is performing before that level is passed to the display means 32 for display to the user.

Figure 1:
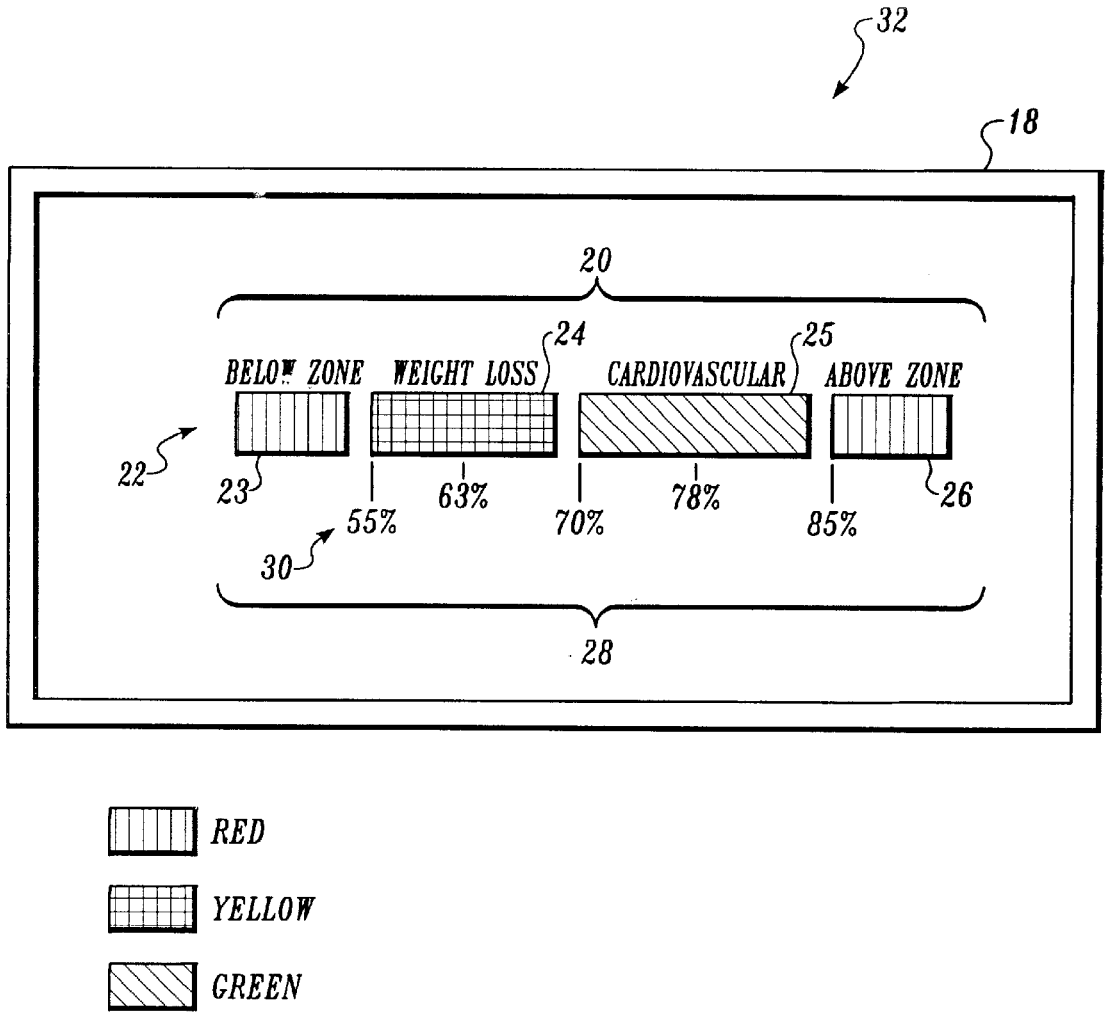
FIG. 1 is a front view of a display means constructed in accordance with the present invention, showing a first preferred embodiment.

A first preferred embodiment of the subdivision 30 is shown in FIG. 1. This embodiment includes a display of the first scale 20 of intensity levels 22 comprising a Below Zone 23, a Weight Loss Zone 24, a Cardiovascular Zone 25, an Above Zone 26. Each of those zones are preferably represented by small lights, formed of a monochromatic LED light source, a separate color being used for each zone 23, 24, 25, and 26. Tricolor diodes can be used as the light source with the color emitted by the diode being controlled by the display system. Such diodes are standard articles of commerce. Lettered indicia are used to label each level 22.

The display means further includes a display of the second scale 28 of subdivisions 30 of maximum heart rate percentages. Each of the subdivisions (these are shown in FIG. 1) are preferably represented by a small, lighted indicia representative of maximum heart rate percentages using monochromatic LEDs or tricolor diodes. The number of subdivisions may be any number, and the value of each subdivision may be fixed or may vary depending on the individual characteristics of the user, as discussed above. Further, the subdivisions may be a single color or may be contrastingly colored.

In this first preferred embodiment, the display means receives information from the calculation means as to which heart rate percentages are to be assigned to which subdivision. When the exercise display system receives the exerciser's heart rate through the sensor, the calculation means determines the user's corresponding heart rate percentage and signals the display means to cause the light of the appropriate subdivision 30 and/or intensity level 22 to flash, or change to a contrasting color.

Figure 2:
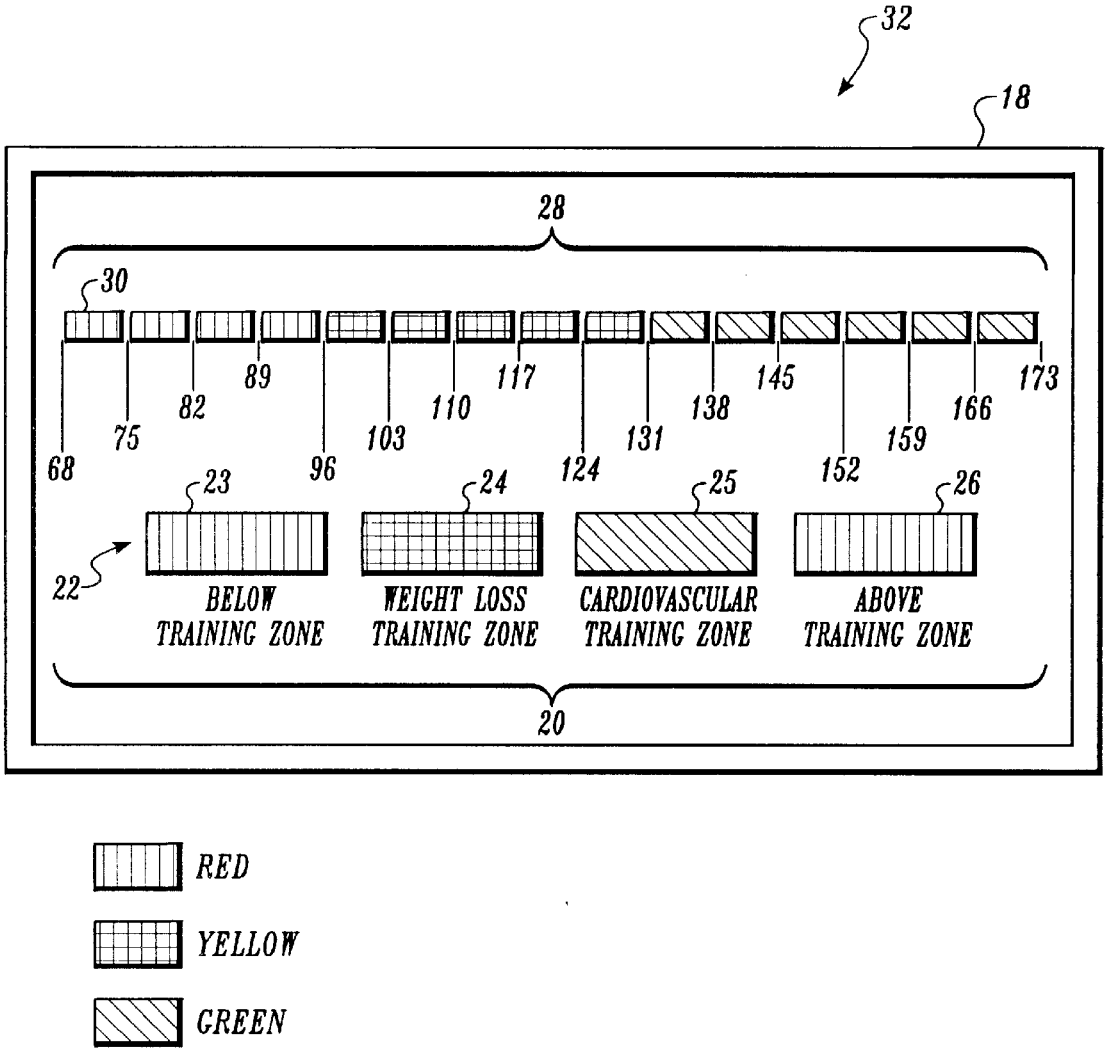
FIG. 2 is a front view of a display means constructed in accordance with the present invention, showing a second preferred embodiment for a first exerciser.
Figure 3:
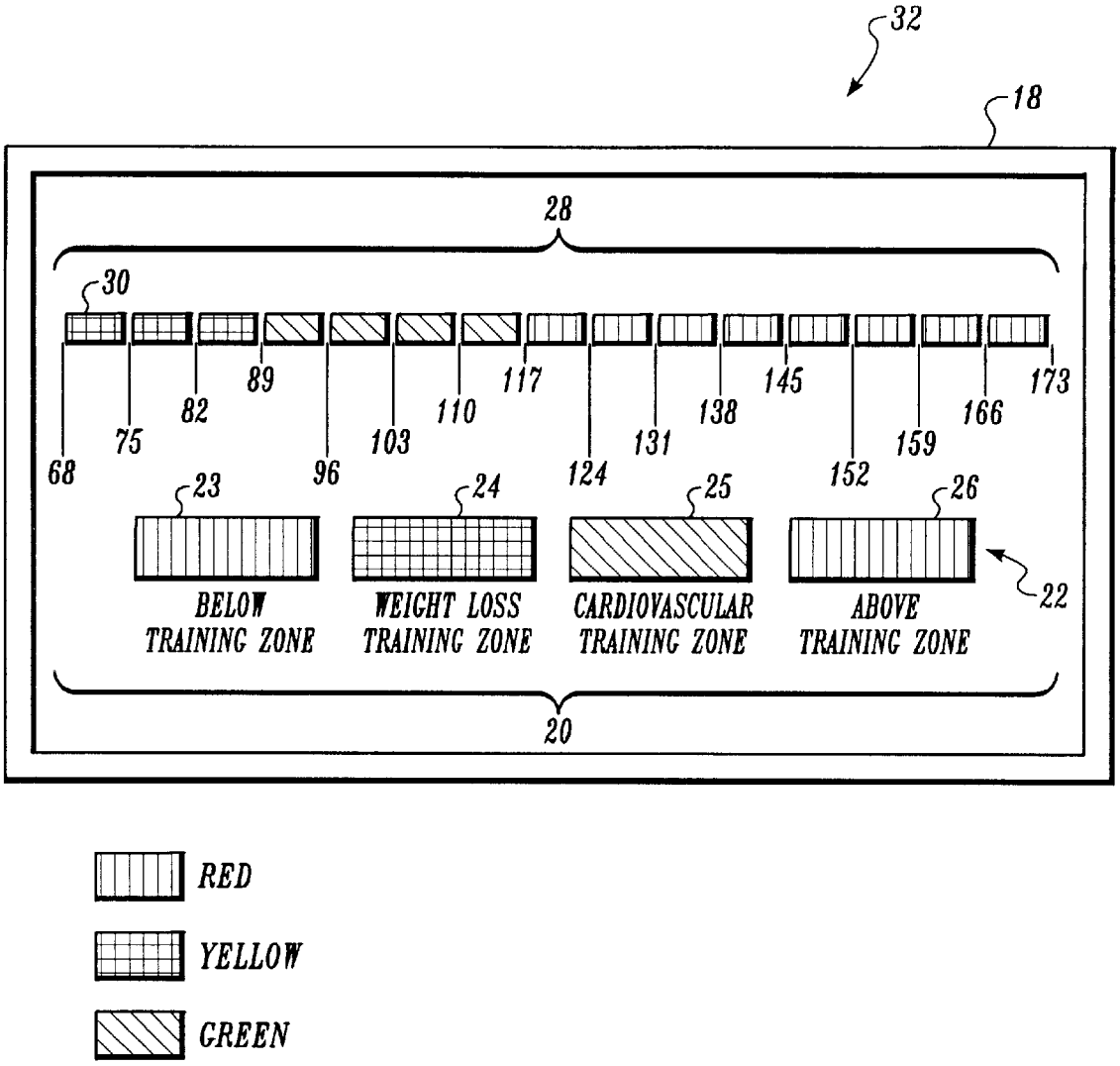
FIG. 3 is a front view of a display means constructed in accordance with the present invention, showing a second preferred embodiment for a second exerciser.

A second preferred embodiment of the subdivisions 30 is shown in FIGS. 2 and 3. This embodiment includes a display of the first scale 20 of intensity levels 22 comprising the Below Training Zone 23, the Weight Loss Training Zone 24, the Cardiovascular Training Zone 25, and the Above Training Zone 26. Each of these zones are preferably represented by small lights, formed of monochromatic LED light sources, a separate color being used for each zone 23, 24, 25, 26. Tricolor diodes can be used as the light source with the color emitted by the diode controlled by the display system. Such diodes are standard articles of commerce. Lettered indicia are used to label each of the levels 22. The display system further includes a display of the second scale 28 of subdivisions 30 of heart rates that range from roughly 60 to 200 beats per minute. Each of the subdivisions are preferably represented by a small, monochromatic LED or tricolor diodes. Numbered heart rate indicia are used to label each of the subdivisions 30. The second scale 28 is placed along side the first scale 20 on the display 18.

In this second preferred embodiment, the display means receives information from the calculation means as to which subdivisions 30 are represented within each of the levels 22. The display means then illuminates the subdivision the appropriate color respective to the intensity level 22 within which it is represented. In this manner, each level 22 and its subdivisions 30 are illuminated the same color. When the display means receives the exerciser's heart rate from the sensor, the display means causes the light of the appropriate heart rate subdivision 30 to flash. Alternatively, the subdivision light may be caused to turn a particular contrasting color.

In FIG. 2 is shown this second preferred embodiment for a fictitious twenty-year-old male. The calculation means 24 has calculated that between 68 to 96 heart beats per minute, the subject would not be within his fitness training zone and hence would not receive many physical benefits from the exercise. The Below Training Zone is illuminated red, as are the subdivisions corresponding to heart rates from 68 to 96 beats per minute. The calculation means has calculated that from 96 to 131 heart beats per minute, the subject would be within his fitness training zone, but would be gaining mostly a caloric benefit from his efforts. Therefore, the Weight Loss Training Zone and the subdivisions corresponding to heart rates from 96 to 131 beats per minute are both illuminated yellow. From 131 to 173 heart beats per minute, the calculation means has determined that the subject would be exercising at a sufficient intensity to provide the subject with a good cardiovascular workout. The remaining six subdivisions are therefore illuminated green, as is the Cardiovascular Training Zone. As the exerciser workouts, the sensor senses his heart rate and the display means receives the heart rate and causes the light of the corresponding subdivision to flash or turn a contrasting color. In this manner, the exerciser can see his particular fitness training range and where his efforts are landing him within that range.

A further example of the second preferred embodiment is shown in FIG. 3 for a second exerciser. This time, the subject is an 80-year-old female. For her, a heart beat rate of between 68 to 89 beats per minute will yield a caloric benefit. A heart beat rate of 89 to 117 beats per minute will yield a cardiovascular benefit, and above 117 will yield an anaerobic workout. Therefore, the Weight Loss Training Zone light and the lights of the subdivisions corresponding to heart rates between 68 and 89 are both illuminated yellow. The Cardiovascular Training Zone and its subdivisions are illuminated green. The heart rates between 89 and 200 are illuminated red. When the woman exercises, the display means will receive her heart rate from the sensor and will cause the light of the corresponding heart rate subdivision to flash or turn a contrasting color.

Figure 4:
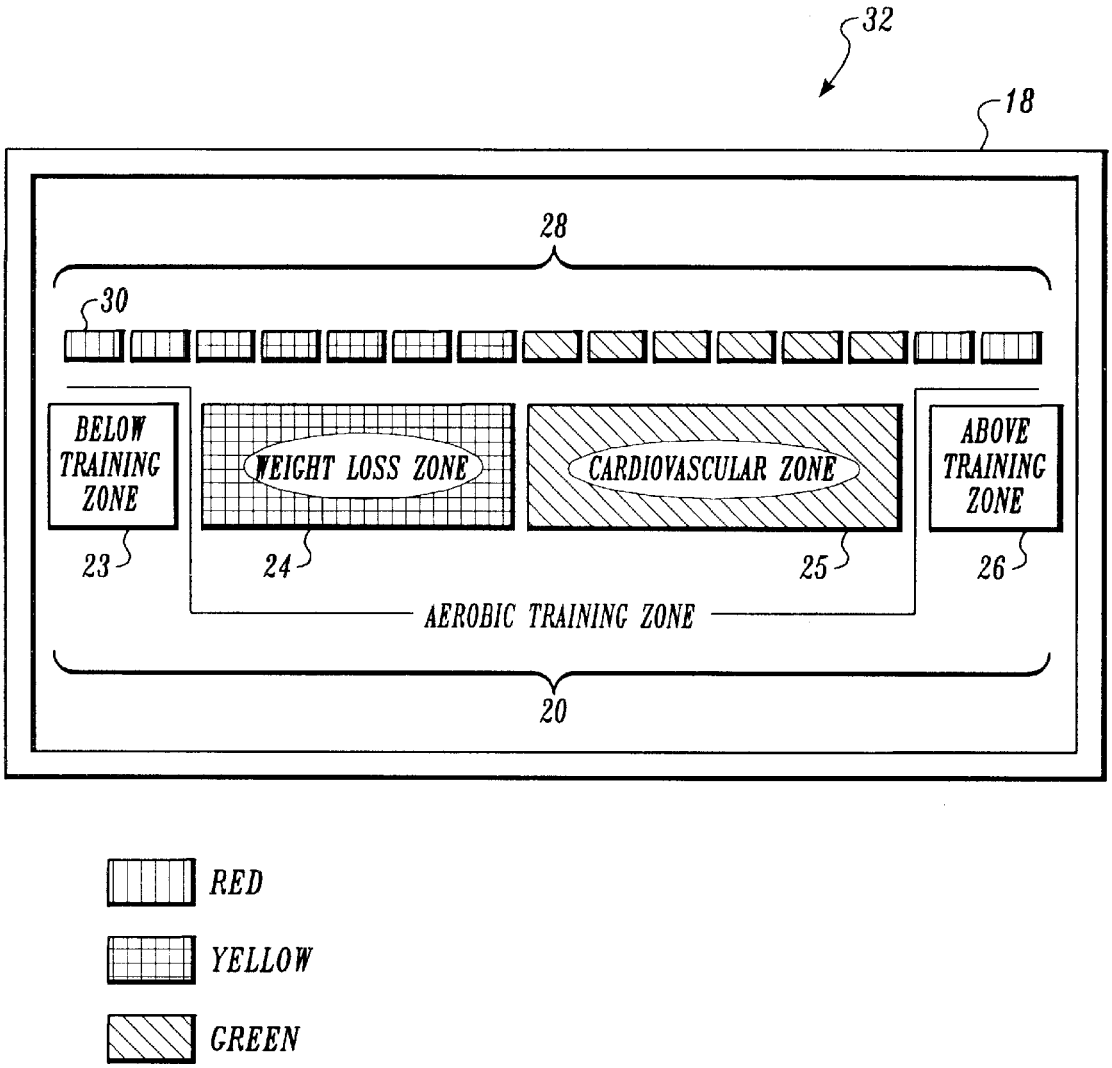
FIG. 4 is a front view of a display means constructed in accordance with the present invention, showing a first form of a third preferred embodiment.

A third preferred embodiment also senses heart rate as the basis for the display 18, and is shown in FIG. 4. The display means includes a fixed number of subdivisions per each of the four preferred zones. The Below Training Zone 23 has two subdivisions; the Weight Loss Zone 24, five; the Cardiovascular Zone 25, six; and the Above Training Zone 26, two. Of course, these numbers may be increased or decreased and are representative herein only. For this embodiment, the calculation means calculates the exerciser's fitness training range using the input physiological information, determines the desired intensity levels 22, and then divides each level 22 by the number of subdivisions of the display means 32 corresponding to that level. In this way, the calculation means assigns heart rates to each subdivision (as opposed to assigning subdivisions to each level, as in the first preferred embodiment). The zones and their corresponding subdivisions may be illuminated in like colors that contrast with the other zone/subdivision lights (as shown in FIG. 4). The zones may all be one color with the subdivisions illuminated in separate color sets (not shown). Or, all zones and subdivisions may be the same illuminated color. These are just a few of the numerous variations that may be made to the display means 32 to present the intensity information to the user. Obviously, different colors may be substituted, different labeling, different orientations of the display, etc., could be made, depending on the designer's preferences and the availability of light sources, and still be within the scope of the present invention. Once the display means receives the exerciser's heart rate from the sensor, the display means causes the light of the appropriate heart rate subdivision 30 to flash or turn a contrasting color.

An example of a first form of the third preferred embodiment may be seen in FIG. 4. The exerciser represented in FIG. 4 is the fictitious 20 year old male of FIG. 1. In this form, the first two subdivisions are a fixed color, shown as red. The first of the two red subdivisions stand for heart rates ranging from 68 through 82, labeled the Below Training Zone. The second of the two stand for heart rates from 83 to 96 beats per minute. The next five subdivisions are labeled the Weight Loss Training Zone and are yet another fixed color (shown as yellow); the first represents heart rates ranging from 96 to 103, the second from 103 to 110, the third from 110 to 117, the fourth from 117 to 124, and the fifth from 124 to 131. The next six subdivisions stand for the Cardiovascular Training Zone and are another fixed color (shown as green). These six subdivisions represent heart rates ranging from 131 to 173 beats per minute. This range is similarly divided equally amongst its subdivisions. The last two subdivisions are for the Above Training Zone and are contrastingly colored to represent heart rates from 173 to 200 beats per minute. As the exerciser works out, the sensor senses his heart rate and the display means causes the light of the corresponding subdivision to flash or turn a contrasting color.

Figure 5:
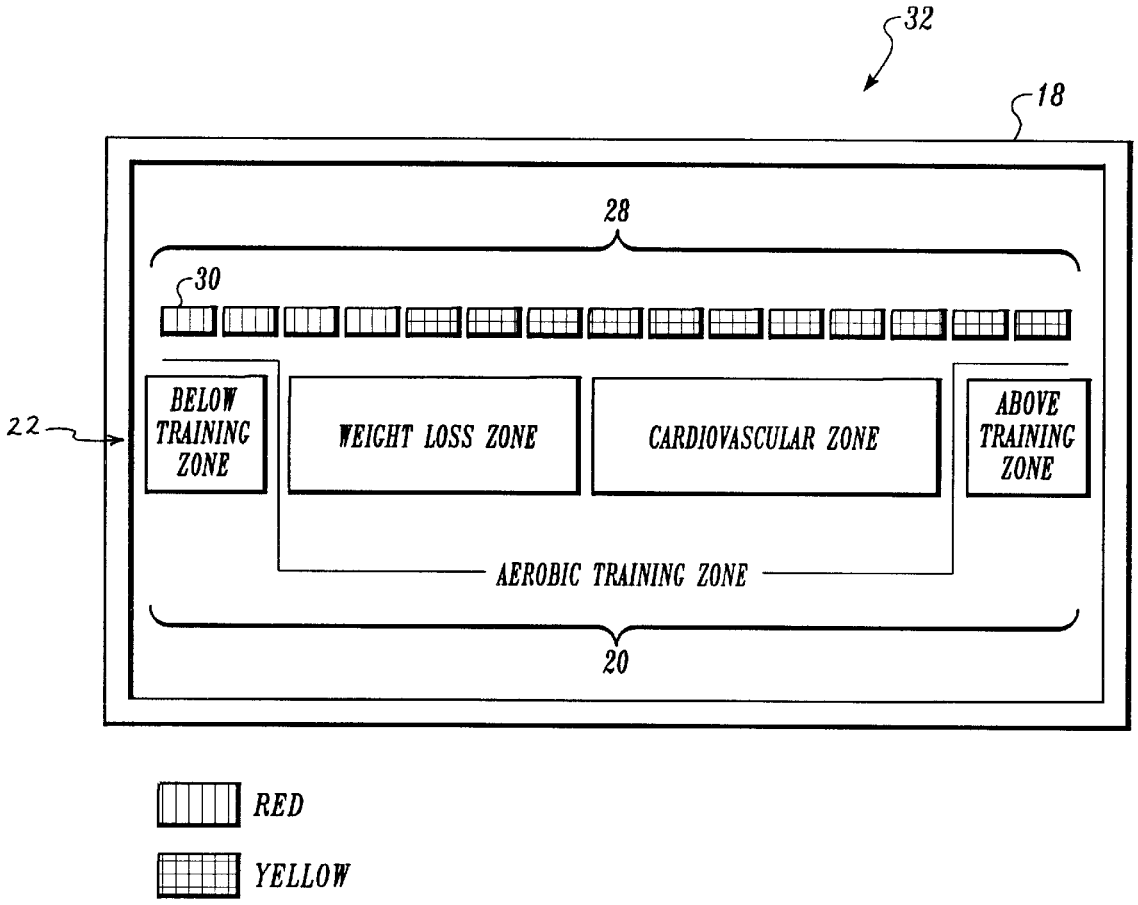
FIG. 5 is a front view of a display means constructed in accordance with the present invention and showing a second form of a third preferred embodiment.

In a second form of the third preferred embodiment, the intensity levels 22 and the subdivisions are all illuminated a single color (shown as yellow). The exerciser's intensity is indicated by the corresponding subdivision, and all subdivisions representing a lesser intensity, are illuminated a contrasting color (shown as red). In this manner, the second scale 28 looks similar to a barometer lying on its side. The greater the exerciser's intensity, the more subdivisions are illuminated. In FIG. 5, the subject is exercising with a heart rate corresponding to the second subdivision of the Weight Loss Training Zone. Therefore, the first two subdivisions of that zone are illuminated red, as are all of the subdivisions of the Below Training Zone. All other subdivisions are yellow.

As may be appreciated from the foregoing description, an exercise display system formed in accordance with the present invention eliminates the need for exercisers to perform mathematical calculations in order to verify their level of exercise intensity at any given time, this information being readily available from the display system.

While the preferred embodiment of the invention has been illustrated and described, it will be appreciated that various changes can be made therein without departing from the spirit and scope of the invention. In particular, the present invention includes other embodiments which may be formed by any number of changes made to the above display means description. The important characteristic is that the display means include a display of a spectrum of exercise intensity levels for the particular exerciser based in part on input information about that individual, and an indication of the intensity of the exerciser's workout within that spectrum. Other embodiments include the use of lights of any available color, shade, or tint. The display means also encompasses the use of a variety of available display media such as color or black and white cathode ray tubes (CRTs), vacuum fluorescent lamps or bulbs, light emitting diodes (LEDs) liquid crystal displays (LCDs), mechanical gauges, etc. Other overall display embodiments include an arrow that slides along side the intensity levels, or subdivisions, to indicate the user's current exercise intensity; or a circle having the intensity levels and subdivisions indicated on its outer periphery and a needle that spins about the center of the circle, pointing to the user's current workout intensity; etc. In addition, the first scale may be used alone to indicate the level of performance of the exerciser, by simply flashing the appropriate intensity level LED, or by causing the appropriate intensity level indicia to turn a particular color, or by other indicia.

The embodiments of the invention in which an exclusive property or privilege is claimed are defined as follows:

1. An exercise display system for aiding a user in maintaining a desired exercise intensity level while exercising, the display system comprising:

(a) input means for inputting relevant physiological information about the user;

(b) calculation means for calculating the appropriate exercise intensity levels for a particular user based in part on the input physiological information about the user, the intensity levels being zones within which a particular exercise benefit may be obtained;

(c) sensor for detecting the physiological condition of the user during exercise; wherein the calculation means uses the physiological condition of the user to determine within which zone the user is currently performing; and (d) display means for displaying the user's exercise intensity based on the detected physiological condition during exercising, the display means including a first scale of at least two levels of possible exercise intensities, the first scale being composed of major subdivisions that correspond to the zones calculated by the calculation means, the first scale including indicia indicating the benefits of each zone.

2. An exercise display system according to claim 1, wherein the first scale of at least two levels of possible exercise intensities of the display means includes a weight loss training zone and a cardiovascular training zone.

3. An exercise display system according to claim 1, wherein the first scale of at least two levels of possible exercise intensities of the display means includes a below training zone, a weight loss training zone, a cardiovascular training zone, and an above training zone.

4. An exercise display system according to claim 1, wherein each of the at least two levels of exercise intensities include a light that flashes when the intensity of the user's exercise is represented by that level.

5. An exercise display system according to claim 1, wherein each of the at least two levels of exercise intensities include a light that turns a particular color when the intensity of the user's exercise is represented by that level.

6. An exercise display system according to claim 1, further comprising a second scale of subdivisions of exercise intensities.

7. An exercise display system according to claim 6, wherein the subdivisions of exercise intensities are located on the display means near the first scale, the subdivisions include indicia indicating the percentage of maximum heart rate at a particular adjacent position on the first scale, relative to a particular user.

8. An exercise display system according to claim 6, wherein the subdivisions of exercise intensities correspond to fixed heart beat rates, and wherein the calculating means calculates which heart beat rates correspond to which intensity levels.

9. An exercise display system according to claim 6, wherein a particular number of subdivisions of exercise intensities correspond to each of the at least two exercise intensity levels, and wherein the calculating means calculates the value of each subdivision corresponding to each of the intensity levels.

10. An exercise display system according to claim 6 wherein the subdivisions of the display means include a light that flashes when the intensity of the user's exercise is represented by that subdivision.

11. An exercise display system according to claim 7 wherein the subdivisions of the display means include a light that flashes when the intensity of the user's exercise is represented by that subdivision.

12. An exercise display system according to claim 8 wherein the subdivisions of the display means include a light that flashes when the intensity of the user's exercise is represented by that subdivision.

13. An exercise display system according to claim 9 wherein the subdivisions of the display means include a light that flashes when the intensity of the user's exercise is represented by that subdivision.

14. An exercise display system according to claim 6 wherein the subdivisions of the display means include a light that illuminates of a particular color when the intensity of the user's exercise is represented by that subdivision.

15. An exercise display system according to claim 7 wherein the subdivisions of the display means include a light that illuminates of a particular color when the intensity of the user's exercise is represented by that subdivision.

16. An exercise display system according to claim 8 wherein the subdivisions of the display means include a light that illuminates of a particular color when the intensity of the user's exercise is represented by that subdivision.

17. An exercise display system according to claim 9 wherein the subdivisions of the display means include a light that illuminates of a particular color when the intensity of the user's exercise is represented by that subdivision.

18. An exercise display system for aiding a user in maintaining a desired exercise intensity level while exercising, the display system comprising:

(a) input means for inputting relevant physiological information about the user;

(b) calculation means for calculating at least two exercise intensity levels for a particular user based in part on the input physiological information about the user, the intensity levels being zones within which a particular exercise benefit may be obtained, the zones being calculated in terms of ranges of heart rates that are congruent with the input physiological information about the user, the intensity levels corresponding to ranges of heart rate;

(c) sensor for detecting the user's heart rate, wherein the calculation means uses the users' heart rate to repeatedly calculate within which zone the user is currently performing;

(d) display means comprising a first scale of at least two levels of possible exercise intensities, the first scale levels corresponding to the zones calculated by the calculation means, the display means including a second scale of subdivisions of heart rates of at least one of the first scale zones; the calculation means calculating the subdivisions of the second scale; and (e) a plurality of spaced apart first indicia representing subdivisions of exercise intensity within a first exercise intensity level, the first indicia indicating the benefits of each zone; and a plurality of spaced apart second indicia representing subdivisions of exercise intensity within the second scale, whereby during a user's workout, the display means provides an indication of the intensity level zone and subdivision within which the user is performing.

19. An exercise display system according to claim 18, wherein each of the plurality of spaced apart first and second indicia includes a light that flashes when the intensity of the user's exercise is represented in that subdivision.

20. An exercise display system according to claim 18, wherein the indicia corresponding to the exercise intensity of the user emits a light of a color related to the particular exercise level of the user.

21. An exercise display system for aiding a user in maintaining a desired exercise intensity level while exercising, the display system comprising:

(a) input means for inputting relevant physiological information about the user;

(b) calculation means for calculating at least two exercise intensity levels for a particular user based in part on the input physiological information about the user, the intensity levels being zones within which a particular exercise benefit may be obtained, the zones each being calculated as a range of values corresponding to a measurable physiological attribute of the user;

wherein the starting and ending points of the zone ranges correspond to specific physiological valves; and wherein once the calculation of the zone ranges is accomplished, the specific physiological start and ending values remain the same throughout the user's workout;

(c) sensor for detecting the measurable physiological attribute of the user during exercise wherein the calculation means continuously compares the users' sensed physiological attribute with the range starting and ending points to determine within which zone the user is currently performing; and (d) display means comprising a first scale of at least two non-varying levels of possible exercise intensities the first scale levels corresponding to the zones calculated by the calculation means; the first scale including indicia indicating the benefits of each zone; whereby during a user's workout, the display means provides an indication of the intensity level zone within which the user is performing.

22. An exercise display system according to claim 18, wherein the zones include starting and ending points corresponding to heart rate valves; and wherein once the calculation of the zones is accomplished, the heart rates represented by each zone remains the same throughout the user's workout.

23. An exercise display system according to claim 18, wherein:

(a) the second scale is physically located near the first scale;

(b) the heart rate subdivisions are expressed in terms of fixed heart rates; and (c) the calculating means calculates which heart rates correspond to which intensity levels; whereby during a user's workout, the display means provides an indication of which fixed heart rate subdivisions correspond to which first scale zone.

24. An exercise display system according to claim 18, wherein:

(a) the second scale is physically located near the first scale;

(b) the heart rate subdivisions are expressed in terms of percentage of maximum heart rate; and (c) the calculation means calculates the heart rate subdivision percentages; whereby during a user's workout, the display means provides an indication of which heart rate percentage subdivisions correspond to which first scale zone.

25. An exercise display system according to claim 18, wherein:

(a) the second scale is physically located near the first scale;

(b) a fixed number of subdivisions correspond to each of the intensity levels; and (c) the calculating means calculates the heart rate values for the fixed number of zone subdivisions.

26. An exercise display system according to claims 18, wherein the second scale is capable of illumination and the display means illuminates the subdivision at which the user is currently performing.

27. An exercise display system according to claim 18, wherein the second scale is capable of illumination and the display means illuminates all subdivisions up to and including the one at which the user is currently performing.

28. An exercise display system according to claim 18, wherein the second scale is capable of intermittent illumination and the display means blinks the subdivision at which the user is currently performing.

29. An exercise display system according to claim 18, wherein the first scale zones are colored, the colors of adjacent zones being different; and the second scale subdivisions are colored to correspond to their respective zone.

30. An exercise display system according to claim 18, wherein the calculation means calculates a weight loss training zone intensity level and a cardiovascular training zone, both being calculated at least in part as a function of heart rate.

31. An exercise display system according to claim 18, wherein the calculation means calculates a below training zone intensity level, a weight loss training zone intensity level, a cardiovascular training zone intensity level, and an above training zone intensity level, all being calculated at least in part as a function of heart rate.

32. The exercise display system according to claim 21:

wherein the zones are calculated in terms of ranges of heart rates that are congruent with the input physiological information about the user;

wherein the zone is defined by specific starting and ending heart rate values; and wherein once the calculation of the zones is accomplished, the heart rates represented by each zone remains substantially the same throughout the user's workout.

33. An exercise display system according to claims 32, wherein the first scale is capable of illumination and the display means illuminates the zone at which the user is currently performing.

34. An exercise display system according to claim 32, wherein the first scale is capable of illumination and the display means illuminates all zones up to and including the one at which the user is currently performing.

35. An exercise display system according to claim 32, wherein the first scale is capable of intermittent illumination and the display means blinks the zone at which the user is currently performing.

36. An exercise display system according to claim 32, further comprising a second scale for displaying a plurality of subdivisions of heart rates of one or more of the first scale zones; the calculation means calculating the subdivisions for display by the second scale; whereby during a user's workout, the display means provides an indication of the intensity level zone and subdivision within which the user is performing.

37. An exercise display system according to claim 36, wherein:

(a) the second scale is physically located near the first scale;

(b) the heart rate subdivisions are expressed in terms of fixed heart rates; and (c) the calculating means calculates which heart rates correspond to which intensity levels; whereby during a user's workout, the display means provides an indication of which fixed heart rate subdivisions correspond to which first scale zone.

38. An exercise display system according to claim 36, wherein:

(a) the second scale is physically located near the first scale;

(b) the heart rate subdivisions are expressed in terms of percentage of maximum heart rate; and (c) the calculation means calculates the heart rate subdivision percentages; whereby during a user's workout, the display means provides an indication of which heart rate percentage subdivisions correspond to which first scale zone.

39. An exercise display system according to claim 36, wherein:

(a) the second scale is physically located near the first scale;

(b) a fixed number of subdivisions correspond to each of the intensity levels; and (c) the calculating means calculates the heart rate values for the fixed number of zone subdivisions.

40. An exercise display system according to claims 36, wherein the second scale is capable of illumination and the display means illuminates the subdivision at which the user is currently performing.

41. An exercise display system according to claim 36, wherein the second scale is capable of illumination and the display means illuminates all subdivisions up to and including the one at which the user is currently performing.

42. An exercise display system according to claim 36, wherein the second scale is capable of intermittent illumination and the display means blinks the subdivision at which the user is currently performing.

43. An exercise display system according to claim 36, wherein the first scale zones are colored, the colors of adjacent zones being different; and the second scale subdivisions are colored to correspond to their respective zone.

44. An exercise display system according to claim 36, wherein the calculation means calculates a weight loss training zone intensity level and a cardiovascular training zone, both being calculated at least in part as a function of heart rate.

45. An exercise display system according to claim 36, wherein the calculation means calculates a below training zone intensity level, a weight loss training zone intensity level, a cardiovascular training zone intensity level, and an above training zone intensity level, all being calculated at least in part as a function of heart rate.

* * * * *

UNITED STATES PATENT AND TRADEMARK OFFICE

CERTIFICATE OF CORRECTION

PATENT NO. : 5,769,755

DATED : June 23, 1998

INVENTOR(S) : G.F. Henry et al.

It is certified that error appears in the above-identified patent and that said Letters Patent is hereby corrected as shown below:

| COLUMN | LINE | |
|---|---|---|
| [56] Pg. 1, col. 1 | Refs. Cited (U.S. Patents) | after the references already cited, please add:<br>--D295,614 5/1988 Touch<br>4,022,192 5/1977 Laukien<br>4,278,095 7/1981 Lapeyre<br>4,443,008 4/1984 Shimano<br>4,708,338 11/1987 Potts<br>4,842,266 6/1989 Sweeney, Sr. et al.<br>5,163,439 11/1992 Dardik<br>5,230,673 7/1993 Maeyama et al.<br>5,323,784 6/1994 Shu<br>5,403,252 4/1995 Leon et al.<br>5,462,504 10/1995 Trulaske et al.<br>5,527,239 6/1996 Abbondanza-- |
| [56] Pg. 1, col. 1 | Refs. Cited (Foreign Patents) | after the references already cited, please add:<br>--06197892A 07/19/1994 Japan<br>05293089 11/09/1993 Japan<br>06014724 04/20/1994 Japan<br>05220120 08/31/1993 Japan-- |
| Pg. 1, col. 2 | Attorney, Agent or Firm | "Christensen, O'Connor, Johnson & Kindness" should read --Christensen O'Connor Johnson & Kindness$^{PLLC}$ -- |
| 2 | 27 | "relative in" should read --relative to-- |

UNITED STATES PATENT AND TRADEMARK OFFICE

CERTIFICATE OF CORRECTION

PATENT NO. : 5,769,755
DATED : June 23, 1998
INVENTOR(S) : G.F. Henry et al.

It is certified that error appears in the above-identified patent and that said Letters Patent is hereby corrected as shown below:

| COLUMN | LINE | |
|---|---|---|
| 2 | 39 | after "sensor" insert --means-- |
| 2 | 53 | "represents" should read --represent-- |
| 2 | 63 | "level" should read --levels-- |
| 2 | 65 | "subdivision" should read --subdivisions-- |
| 3 | 33 | after "embodiment;" insert --and-- |
| 4 | 58 | after "Zone 25," insert --and-- |
| 5 | 35 | "diodes" should read --diode-- |
| 5 | 36 | "along side" should read --alongside-- |
| 6 | 1 | "workouts" should read --works out-- |
| 6 | 24 | "per" should read --for-- |
| 6 | 57 | "stand" should read --stands-- |
| 6 | 59 | "stand" should read --stands-- |
| 7 | 47 | "along side" should read --alongside-- |

UNITED STATES PATENT AND TRADEMARK OFFICE

CERTIFICATE OF CORRECTION

PATENT NO. : 5,769,755
DATED : June 23, 1998
INVENTOR(S) : G.F. Henry et al.

It is certified that error appears in the above-identified patent and that said Letters Patent is hereby corrected as shown below:

| COLUMN | LINE | |
|---|---|---|
| 9 (Claim 14, | 3 line 3) | after "illuminates" delete "of" |
| 9 (Claim 15, | 7 line 3) | after "illuminates" delete "of" |
| 9 (Claim 16, | 11 line 3) | after "illuminates" delete "of" |
| 9 (Claim 17, | 15 line 3) | after "illuminates" delete "of" |
| 9 (Claim 18, | 32 line 16) | "users'" should read --user's-- |
| 10 (Claim 21, | 6 line 14) | "valves" should read --values-- |
| 10 (Claim 21, | 13 line 21) | "users'" should read --user's-- |
| 10 (Claim 21, | 18 line 26) | after "intensities" insert a comma |

UNITED STATES PATENT AND TRADEMARK OFFICE

CERTIFICATE OF CORRECTION

PATENT NO. : 5,769,755

DATED : June 23, 1998

INVENTOR(S) : G.F. Henry et al.

It is certified that error appears in the above-identified patent and that said Letters Patent is hereby corrected as shown below:

| COLUMN | LINE | |
|---|---|---|
| 10 (Claim 22, | 27 line 3) | "valves" should read --values-- |
| 10 (Claim 26, | 62 line 1) | "claims" should read --claim-- |
| 11 (Claim 33, | 32 line 1) | "claims" should read --claim-- |
| 12 (Claim 40, | 28 line 1) | "claims" should read --claim-- |

Signed and Sealed this

Fourteenth Day of September, 1999

*Attest:*

Q. TODD DICKINSON

*Attesting Officer*

*Acting Commissioner of Patents and Trademarks*